US012560402B2

(12) United States Patent
Elliott

(10) Patent No.: US 12,560,402 B2
(45) Date of Patent: Feb. 24, 2026

(54) RECOIL SYSTEM

(71) Applicant: BAE SYSTEMS PLC, London (GB)

(72) Inventor: Edward Elliott, Farnborough (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/702,864

(22) PCT Filed: Oct. 10, 2022

(86) PCT No.: PCT/GB2022/052558
§ 371 (c)(1),
(2) Date: Apr. 19, 2024

(87) PCT Pub. No.: WO2023/067300
PCT Pub. Date: Apr. 27, 2023

(65) Prior Publication Data

US 2024/0410670 A1 Dec. 12, 2024

(30) Foreign Application Priority Data

Oct. 22, 2021 (GB) ..... 2115240

(51) Int. Cl.
*F41A 25/16* (2006.01)

(52) U.S. Cl.
CPC ..... *F41A 25/16* (2013.01)

(58) Field of Classification Search
CPC ..... F41A 23/34; F41A 25/16
USPC ..... 89/40.02
See application file for complete search history.

(56) References Cited

U.S. PATENT DOCUMENTS 1,485,836 A * 3/1924 Delano ..... B62D 55/10 305/130
6,457,396 B1 10/2002 Bean et al.
9,481,414 B1 11/2016 Thielman et al.
2003/0158635 A1* 8/2003 Pillar ..... B60L 50/15 701/1

FOREIGN PATENT DOCUMENTS

WO 2006091240 A2 8/2006
WO 2023067300 A1 4/2023

OTHER PUBLICATIONS

International Search Report and Written Opinion received for PCT/GB2022/052558. Mailed: Jan. 17, 2023. 9 pages.
GB Search Report under Section 17(5) received for GB Application No. 2115240.0. Dated: Mar. 11, 2022. 3 pages.

* cited by examiner

*Primary Examiner* — Bret Hayes
(74) *Attorney, Agent, or Firm* — Finch & Maloney PLLC

(57) ABSTRACT

A field gun, comprising an elevating mass and a wheeled carriage. The elevating mass includes an ordnance for firing a projectile, and a cradle for holding the ordnance at a traverse and an elevation. The ordnance includes a barrel defining a barrel axis and having a muzzle towards a front end of the field gun and a breech assembly at a rear end of the barrel. The wheeled carriage is connected to the cradle and includes at least one wheel, a rechargeable electric storage device, and a regenerative braking system, which includes a brake control configured for applying a braking force to said at least one wheel in response to movement of the wheeled carriage, said movement caused by a recoil force from the firing of the projectile from the barrel.

20 Claims, 4 Drawing Sheets

RECOIL SYSTEM

FIELD

The present invention relates to a field gun with wheel carriage, specifically to a wheel carriage with regenerative braking system as part of the recoil system.

In certain known howitzer field guns the ordnance is aimed (i.e. has traverse or elevation varied) using a carriage and soleplate arrangement. In such typical field guns the soleplate is a plate-like platform that sits on the ground so as to bear the weight of the Gun and oppose any forward tipping moments; forward tipping moments are greatest during counter recoil. The soleplate is provided with a carriage mounted on top. The soleplate and carriage are connected by a swivel joint, thus the carriage can swivel in the plane of the ground (e.g. when the ground is horizontal, the carriage will swivel in a horizontal plane) so as to vary the ordnance traverse. The carriage is connected to the ordnance by way of trunnions that extend laterally from the cradle thus the ordnance can rotate about the trunnion/saddle connection to vary the elevation.

It is known that field guns are desired to be lightweight. Lightweight field guns are desirable because they can be transported by a wider range of vehicles and because a greater number of them may be carried by a given transport vehicle. Thus field guns can be deployed faster than heavier alternatives.

SUMMARY

According to an aspect of the present invention, there is provided a field gun, comprising:

i) an elevating mass which comprises:

an ordnance for firing a projectile, the ordnance comprising a barrel defining a barrel axis and having a muzzle towards the front end of the howitzer and a breech assembly at the rear end of the barrel; and a cradle for holding the ordnance at a traverse and an elevation; and at least one co-operative engagement means, for linking said cradle to a wheeled carriage, ii) said wheeled carriage comprising at least one wheel;

a rechargeable electric storage device; and a regenerative braking system comprising:

a brake control configured for applying a braking force to said at least one wheel in response to movement of the wheeled carriage by a recoil force from the firing of the projectile from the gun barrel.

The regenerative device may be operably linked with the rechargeable electric storage device and the at least one wheel for dissipating the recoil of the field gun by decelerating the wheel, and additionally generating an electrical current.

Preferably there is a processor connected to the brake control and to the rechargeable electric storage device such that in response to a first movement of the carriage, caused by the recoil from firing the gun, the processor causes the regenerative device to decelerate the wheel, and dissipate the energy of the recoil. The first movement being a movement caused by the recoil force from the firing of the projectile from the gun barrel.

The carriage may be towed or self-propelled vehicle, preferably the carriage is a self-propelled vehicle. The carriage may be electrically powered or combustion engine powered. In a highly preferred arrangement the carriage is an electric powered vehicle or hybrid-electric powered vehicle.

The electric storage may be a rechargeable battery and/or may comprise a fast charging capacitor. The capacitor may be able to accept a generated charge at a much faster rate than a rechargeable battery. The electric vehicle may comprise an electric motor operatively connected to a driving wheel and/or the at least one wheel to drive the driving wheel and/or at least one wheel; and a motor controller configured to connect the rechargeable electric storage device to the electric motor to power the motor. The electrical storage system may also provide electrical power to operate the electronic components on the gun system, such as, for example the fire control system, aiming, communications, loading ammunition, etc.

The regenerative braking system may be used in combination with an internal combustion engine powered vehicle, wherein the electrical storage device is used to provide electrical power either as supplementary driving power and/or to operate the electronic components on the gun system, such as, for example the fire control system, aiming, communications, loading ammunition, etc.

The vehicle may preferably have more than one wheel, preferably two or three; there may be at least four wheels, with at least one wheel comprising said regenerative braking system. Many military vehicles have 6, 8 or more wheels, with any one or all being driven wheels or at least one wheels. The vehicle may comprise wheels for steering and/or driving. The at least one wheel may also be a steering, driving or drop axle wheel (non-driving wheel).

The at least one wheel may also be a drive wheel, road wheel or idler wheel (non-driving wheel) of a tracked vehicle.

The regenerative braking system may preferably be applied to pairs of wheels, to allow a uniform braking force to be applied. It is desirable that braking is performed in a substantially straight line, to avoid the carriage and gun from moving sideways, which may cause tipping, (ie deceleration may preferably be only in the direction of the main axis which is defined as the axis of the gun and wheeled carriage). Steering may be locked during the firing of the gun, to confine movement in only the main axis, to mitigate tipping of the gun.

To further prevent uncontrolled braking, the regenerative braking system may comprise an anti-lock braking system (ABS). The regenerative braking, effect may be reduced or immediately removed when antilock braking is activated. The ABS ensures that the recoil force is reduced and does not cause the carriage to enter into a skid, which may be difficult to control should the recoil force cause any movement no along the main axis. The ABS may be an algorithm on the processer of the regenerative braking system or a separate ABS friction braking system.

The elevating mass may comprise a piston recoil system and a piston recuperator system, applied to the barrel in a conventional manner.

The regenerative braking system may be used as a primary means or secondary means of retarding ie absorbing the recoil force. Preferably the degree of resistance of the piston recoil system and regenerative braking system are controlled by the processor to ensure that the gun system has the recoil energy safely dissipated and to maximise the generation of electricity.

The regenerative braking system may be applied progressively to increase the amount of braking force during the recoil force.

On a standard hydro-pneumatic system, the recoil force can be controlled by changing the buffer porting along the length of the stroke. This energy may be arranged to transfer a portion of the stored hydro-pneumatic system energy to the regen system. A hydro-pneumatic system comprising a valve arrangement, or means of variably controlling the port size/position adjustment in the hydro-pneumatic system may also allow the ratio of recoil force between the hydro-pneumatic system and the regenerative systems to be adjusted with respect to time, and further depending on the mass of the charge used to propel the ammunition.

The response to the first movement of the vehicle, may be any detected by a motion detector, either mounted on the vehicle, such as the wheel, or part of the regenerative braking system. The movement, such as velocity and acceleration may be monitored to determine the amount of recoil force originating from the firing of the gun, and thereby to determine the counter opposing force required by the regenerative braking system and the piston recoil system.

In a preferred arrangement, the vehicle comprises a regenerative braking system having at least one wheel, preferably at least a pair of front wheels and pair of rear wheels, wherein at least one set of wheels includes a drive wheel, an actuating device, a regenerative braking control circuit, and power electronics. The regenerative braking control circuit may include a transducer, such as for example a potentiometer or digital encoder, a process sensor, and the processor. The power electronics circuit includes a rechargeable electric power source, an electric motor, and a motor controller. The actuating device may be coupled to the transducer. The transducer and process sensors signal the processor which produces an output signal to the motor controller for regulating a regenerative braking torque to the at least one wheel.

The braking system applies a regenerative braking torque to the at least one wheel when the transducer signals a regenerative braking command, and the process sensors receive a signal from the motion detector via the at least one wheel, that the velocity greater than zero. Preferably, the braking torque increases with an increase in the transducer signal as detected by the motion detector, and the processor adjusts the braking torque. Thereby, in the regenerative braking mode, the motor acts as a generator supplying current to the battery which loads down the generator, thereby causing a braking action.

There may be a gearbox or variable transmission system located between the at least one wheel and the regenerative braking system. The gearbox may increase the speed of the regenerative braking system, such as to increase the flux cutting in the regenerative system, to improve the braking force of the regenerative system.

Wheeled vehicles typically comprise suspension systems, to allow the vehicle to traverse over uneven ground. The suspension systems may be passive or active, and may dissipate part of the recoil force.

The carriage assembly may also comprise conventional passive recoil systems, such as physical components which are pushed into the ground to allow recoils forces to be directed into the ground; the carriage may further comprise i) a body unit, comprising ii) a pair of front stabilisers, iii) a pair of rear trails;

The front stabilisers may extend to rest on the ground at a foremost ground contact point and the rear trails extend to rest on the ground at a backmost ground contact point such that the foremost ground contact point is situated below the barrel and substantially forwards of the field gun's centre of gravity so as to be able to oppose the tipping moment induced during counter-recoil.

The rear trails may comprise a trail leg, a trail arm pivotally connected to said trail leg, a spade and a damper, wherein said damper is located between the trail leg and trail arm.

The trail leg is required to maintain the rearward position of the spades relative to the elevating mass in order to achieve stability, particularly when firing at low elevation. A damper may be fitted into the trail leg and when deployed in the firing position the damper piston seats against the underside of the trail arm. The damper provides resilience between the leg and the arm and allows the spade to rotate about the trail leg/arm hinge to self-dig into the ground during firing.

Beneficially the front stabilisers and rear trails are therefore at the periphery of the field gun's ground base and so they can oppose the forces that the howitzer experiences during firing so that the field gun does not topple Conventional passive recoil systems may be required where regenerative braking is not possible, such a wet, icy, in essence a slippery surface where brakes may not provide sufficient stability.

BRIEF DESCRIPTION OF THE FIGURES

Embodiments of the invention will now be described by way of example only with reference to the figures, in which.

DETAILED DESCRIPTION

Figure 1A:
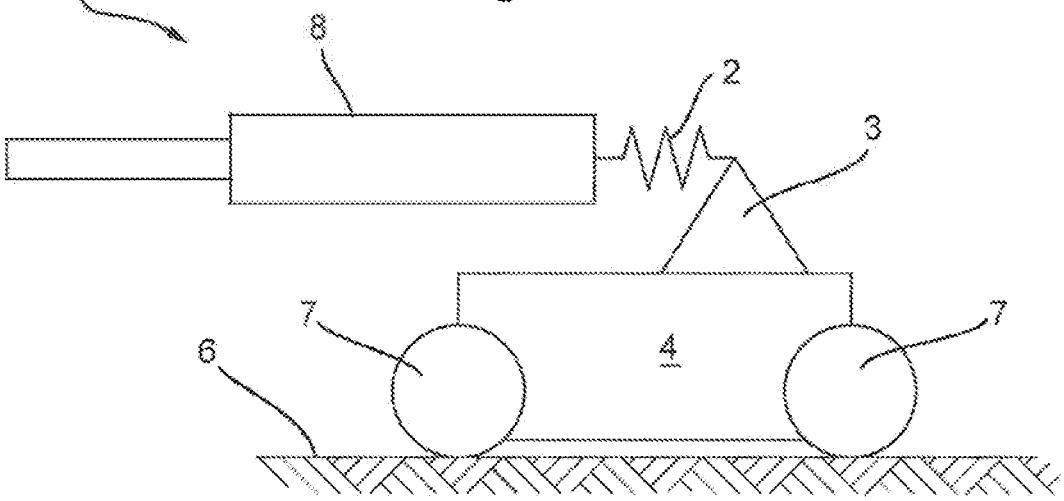
FIGS. 1*a* and 1*b* show a simplified view
Figure 1B:
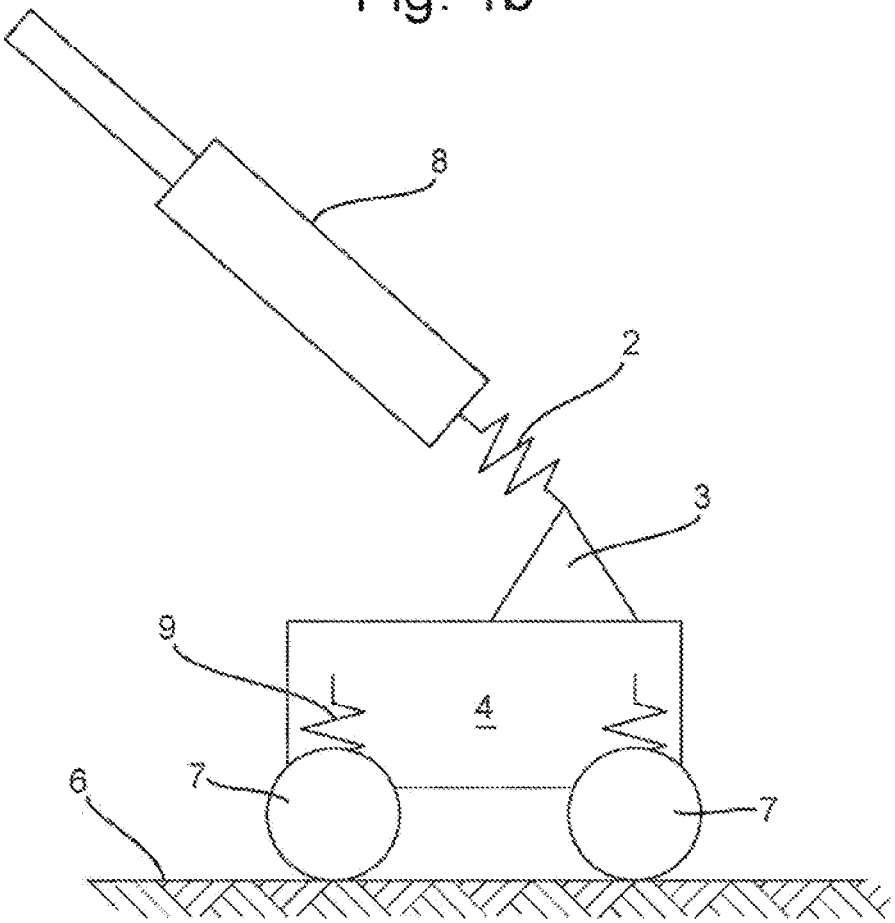

Turning to FIGS. 1*a* and 1*b*, there is provided a schematic of a gun system 1, with a body 4, wheels 7. The body 4 comprising a trunnion 3 which provides a bearing for the gun barrel 8 to be mounted on. The gun barrel 8, further comprising a recoil/recuperator system 2, to absorb the energy. The wheels 7 being generally connected to the body 4, by means of vehicle suspension 9.

Figure 2A:
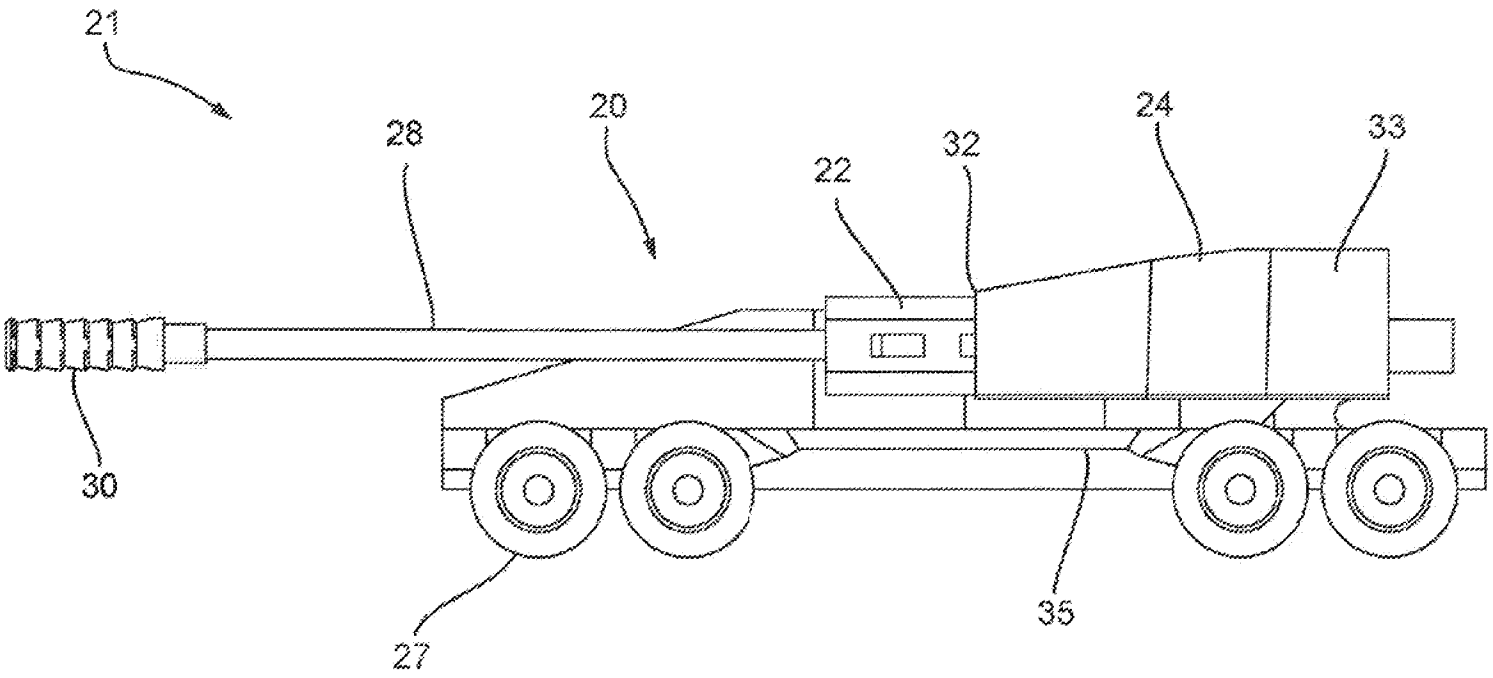
FIGS. 2*a* and 2*b* show a wheeled field gun.
Figure 2B:
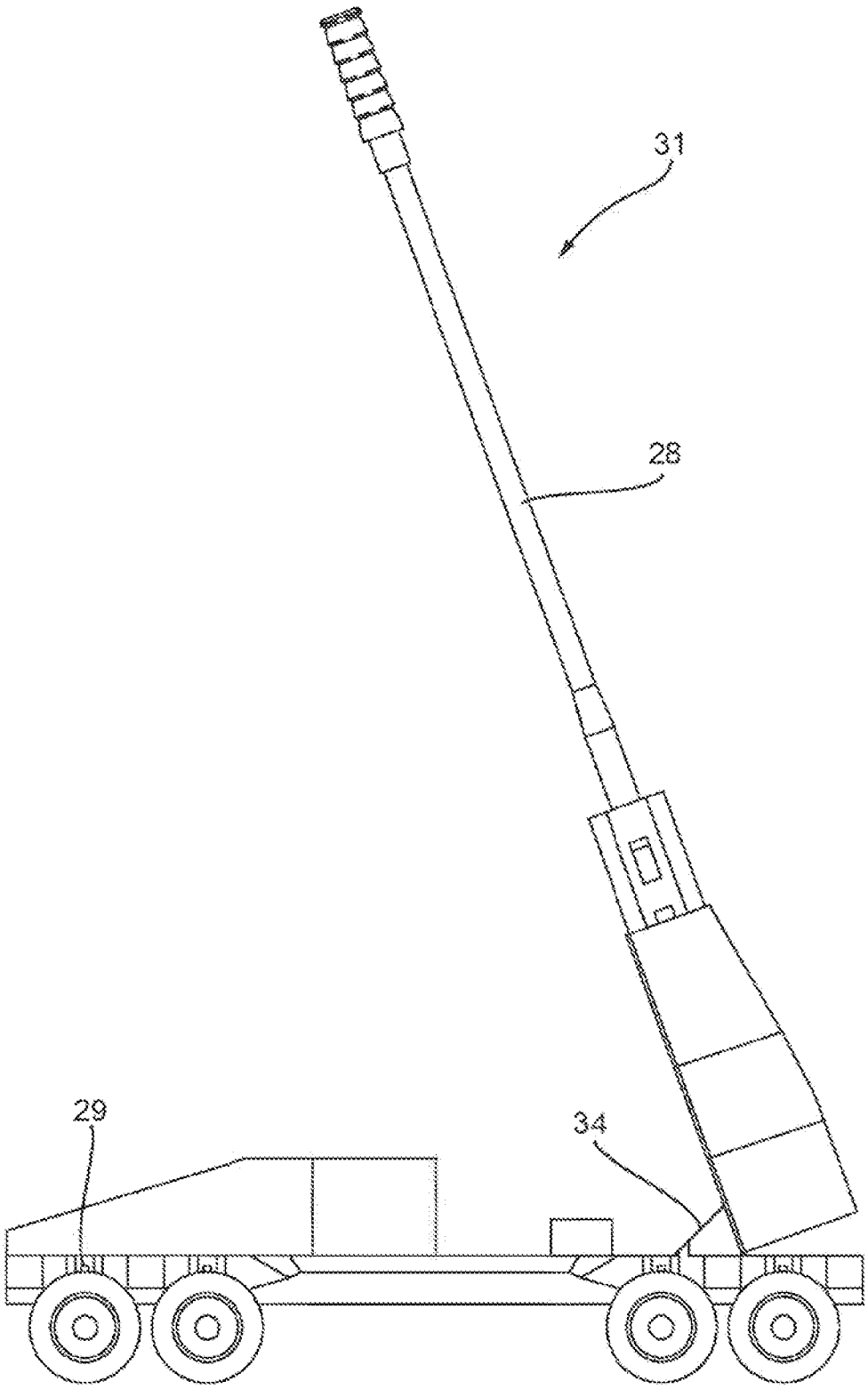

Turning to FIGS. 2*a* and 2*b*, FIG. 2*a* is in a horizontal firing position 21, and FIG. 2*b* provides a high angle elevation firing position 31. The field gun 20 comprising an elevating mass 28 with a barrel/ordnance 32 for firing a projectile. The barrel axis is the main axis of the vehicle and the gun barrel 32. The muzzle and muzzle brake 30 is located at the nominal front end of the field gun, with a breech 33 assembly at the rear end of the barrel. The cradle 34 holds the ordnance at a traverse and an elevation. The wheeled carriage 35 comprising at least one wheel 27. The wheels may be driven by a combustion engine electrical motors, or hybrid means (not shown). The wheels are linked to he carriage 35 by suspension 29.

Figure 3:
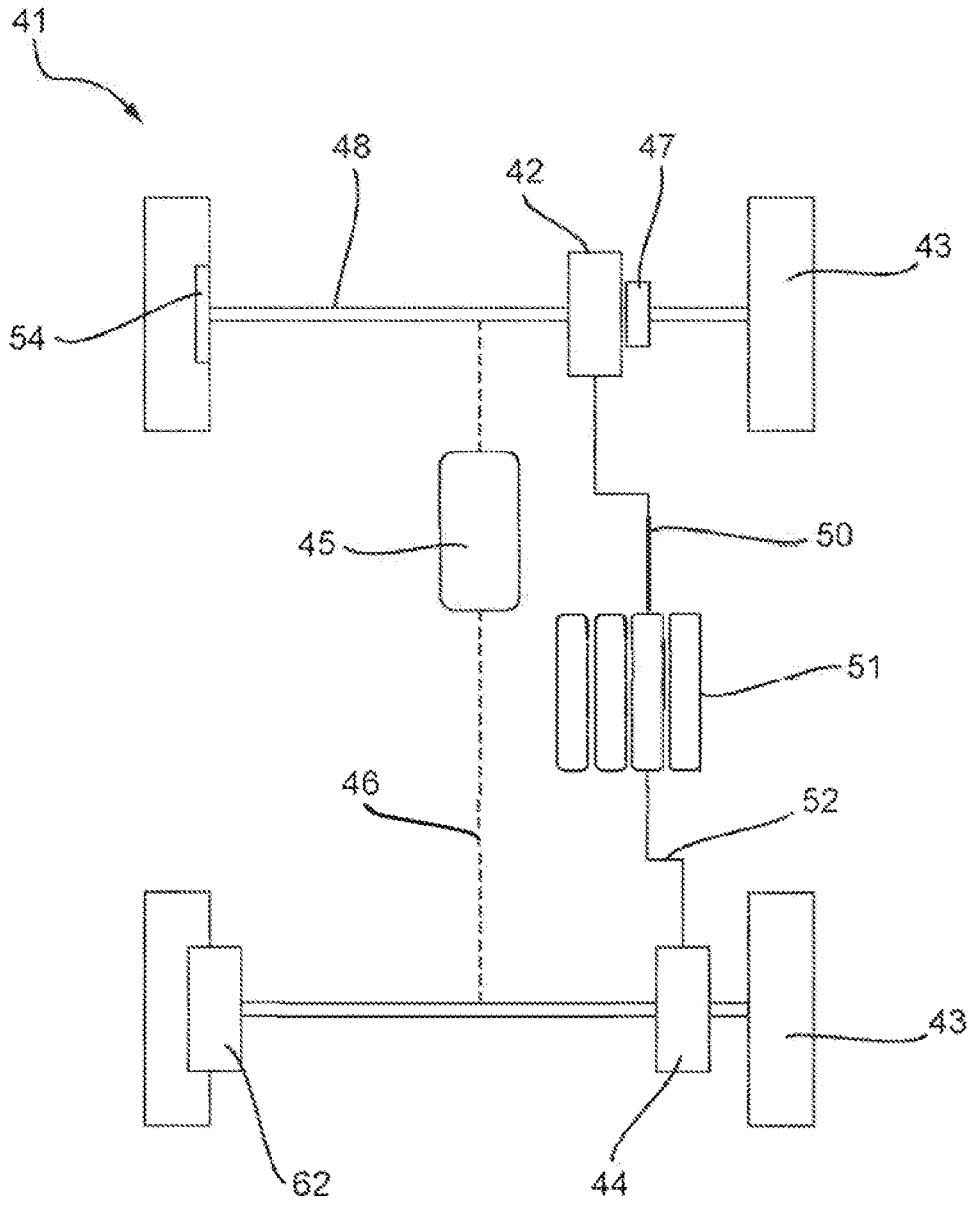
FIG. 3 shows a regenerative braking system according to the invention

Turning to FIG. 3 there is a simplified plan view of a wheeled carriage 41, comprising a rechargeable electric storage device 51; and a regenerative braking system 42. The regenerative a system comprising a brake control (not shown) configured for applying a braking force to the wheel 43 in response to movement of the carriage 41 by a recoil force from the firing of the projectile from the gun barrel.

The regenerative braking system 42 is located on an axle 48. Alternatively, a wheel hub mounted regenerative braking system 62 is located on each wheel. 43. The regenerative braking system 42, 62, may further comprise a gearbox 47 or variable transmission means to speed up the flux cutting in the regenerative braking system, so as to allow slow carriage velocities to still provide an effective regenerative braking force. The wheels 43 may also further comprise friction brakes 54, to provide greater stopping forces.

The carriage 41 may be powered by a driven train 45, such as, an internal combustion engine, electric motor or hybrid, wherein the drive may be transferred by drive shafts 46. The carriage may be powered by electrical motors 44 located either proximate to or located within (hub motor) the wheels 43. The electrical power 52 may be provided by the rechargeable battery 51. The rechargeable battery 51 may be recharged by the action of the regenerative braking system 42, 62 which flows electricity 50 into the rechargeable battery 51.

The invention claimed is:

1. A field gun, comprising:

an elevating mass comprising an ordnance for firing a projectile, the ordnance comprising a barrel defining a barrel axis and having a muzzle towards a front end of the field gun and a breech assembly at a rear end of the barrel, and a cradle for holding the ordnance at a traverse and an elevation; and a wheeled carriage connected to the cradle and comprising at least one wheel, a rechargeable electric storage device, and a regenerative braking system comprising a brake control configured for applying a braking force to said at least one wheel in response to movement of the wheeled carriage, said movement caused by a recoil force from the firing of the projectile from the barrel.

2. The field gun according to claim 1, wherein the regenerative braking system is operably linked with the rechargeable electric storage device and the at least one wheel, for generating an electrical current by decelerating the at least one wheel and dissipating the recoil force of the field gun.

3. The field gun according to claim 1, wherein there is a processor connected to the brake control and to the rechargeable electric storage device, such that in response to a movement of the wheeled carriage, the processor causes the regenerative braking system to decelerate the at least one wheel.

4. The field gun according to claim 1, wherein the wheeled carriage is an electric driven vehicle, said vehicle comprising:

an electric motor operatively connected to the at least one wheel to drive the at least one wheel; and a motor controller configured to connect the rechargeable electric storage device to the electric motor, to power the electric motor.

5. The field gun according to claim 1, wherein the at least one wheel comprises an anti-lock braking system.

6. The field gun according to claim 1, wherein there are at least four wheels, with at least one wheel comprising said regenerative braking system.

7. The field gun according to claim 1, wherein the elevating mass comprises a piston recoil system and a piston recuperator system.

8. The field gun according to claim 1, wherein the wheeled carriage comprises a body unit, the body unit comprising: a pair of front stabilisers, and a pair of rear trails.

9. The field gun according to claim 8, wherein each of the said rear trails comprises a trail leg, a trail arm which is pivotally connected to said trail leg, a spade, and a damper, wherein said damper is located between the trail leg and trail arm.

10. The field gun according to claim 8, wherein the front stabilisers and rear trails are located at a periphery of the body unit, such that they oppose forces the field gun experiences during firing.

11. A field gun, comprising:

a gun barrel; and a wheeled carriage connected to the gun barrel and comprising at least one wheel, a rechargeable electric storage device, and a regenerative braking system configured for applying a braking force to said at least one wheel responsive to movement of the wheeled carriage, said movement caused by a recoil force from firing of a projectile from the gun barrel.

12. The field gun according to claim 11, wherein the regenerative braking system is operably linked with the rechargeable electric storage device and the at least one wheel, and configured to: generate an electrical current by decelerating the at least one wheel and dissipating the recoil force of the field gun; and store the electrical current in the rechargeable electric storage device.

13. The field gun according to claim 11, comprising a processor powered by the rechargeable electric storage device and connected to the regenerative braking system, the processor configured to cause the regenerative braking system to decelerate the at least one wheel via, responsive to a movement of the wheeled carriage.

14. The field gun according to claim 11, wherein the wheeled carriage is an electric driven vehicle, said vehicle comprising:

an electric motor operatively connected to the at least one wheel to drive the at least one wheel; and a motor controller configured to connect the rechargeable electric storage device to the electric motor, to power the electric motor.

15. The field gun according to claim 11, wherein the regenerative braking system comprises an anti-lock braking system.

16. The field gun according to claim 11, wherein the wheeled carriage includes at least four wheels.

17. The field gun according to claim 11, comprising a piston recoil system and a piston recuperator system, each coupled to the gun barrel.

18. The field gun according to claim 11, wherein the wheeled carriage comprises a pair of front stabilisers, and a pair of rear trails, wherein each of the said rear trails comprises a trail leg, a trail arm which is pivotally connected to said trail leg, a spade, and a damper, wherein said damper is located between the trail leg and trail arm, and wherein the front stabilisers and rear trails are located at a periphery of the wheeled carriage, such that they oppose forces the field gun experiences during firing.

19. A field gun, comprising:

a wheeled carriage comprising at least one wheel; and a regenerative braking system configured to generate an electrical current by decelerating the at least one wheel responsive to movement of the at least one wheel, and store the electrical current in a rechargeable electric storage device, wherein the movement of the at least one wheel is caused by a recoil force from firing of the field gun.

20. The field gun according to claim 19, comprising:

a processor configured to cause the regenerative braking system to decelerate the at least one wheel, responsive to a movement of the wheeled carriage.

* * * * *